US006398148B1

(12) United States Patent
Snow

(10) Patent No.: US 6,398,148 B1
(45) Date of Patent: Jun. 4, 2002

(54) DEVICE AND METHOD FOR STORING HOLIDAY LIGHT STRINGS

(76) Inventor: Mark Snow, 1216 Virginia, Libertyville, IL (US) 60048

( * ) Notice: Subject to any disclaimer, the term of this patent is extended or adjusted under 35 U.S.C. 154(b) by 0 days.

(21) Appl. No.: 09/557,138

(22) Filed: Apr. 25, 2000

(51) Int. Cl.[7] ..... B65H 75/10; B65H 75/28; B65H 75/30; B65H 75/40

(52) U.S. Cl. ..... 242/395.1; 242/404.3; 242/406; 242/407; 242/597.5; 242/597.7; 242/613.1; 242/401

(58) Field of Search ..... 242/395, 395.1, 242/404.3, 406, 407, 597.7, 597.5, 613.1, 613.2, 401; 206/419, 420

(56) References Cited

U.S. PATENT DOCUMENTS

| | | | | | |
|---|---|---|---|---|---|
| 289,960 | A | * | 12/1883 | Billings | 242/407 |
| 2,197,767 | A | * | 4/1940 | Neale | 242/597.7 |
| 2,561,376 | A | * | 7/1951 | Johnson | 242/597.7 |
| 2,562,650 | A | * | 7/1951 | Trunkhill | 242/597.7 |
| 4,357,653 | A | | 11/1982 | Kovacs | |
| 4,917,323 | A | | 4/1990 | Wing | |
| 4,944,472 | A | * | 7/1990 | Stahl | 242/597.7 |
| 4,979,693 | A | * | 12/1990 | Eberhardt et al. | 242/395 |
| 5,064,067 | A | | 11/1991 | McAllister et al. | |
| 5,168,999 | A | | 12/1992 | Lee et al. | |
| 5,214,903 | A | | 6/1993 | Chen et al. | |
| 5,287,965 | A | | 2/1994 | Miller | |
| 5,458,241 | A | | 10/1995 | Brown | |
| 5,482,226 | A | | 1/1996 | Choate | |
| 5,510,966 | A | | 4/1996 | Konecny | |
| D375,251 | S | | 11/1996 | Stevens et al. | |
| 5,582,291 | A | | 12/1996 | Schroeder et al. | |
| 5,597,070 | A | | 1/1997 | Wu | |
| 5,598,985 | A | | 2/1997 | Winesett | |
| 5,641,075 | A | | 6/1997 | Mechlin | |
| 5,661,953 | A | | 9/1997 | Jolley | |
| 5,691,075 | A | | 11/1997 | Batawi | |
| 5,762,311 | A | | 6/1998 | Triglia | |
| 5,842,655 | A | * | 12/1998 | McCarthy | 242/597.7 |
| 5,907,945 | A | | 6/1999 | Doyle | |
| 5,924,570 | A | | 7/1999 | Sickles | |
| 5,934,598 | A | | 8/1999 | Kovacik et al. | |
| 5,941,388 | A | | 8/1999 | Spielberger | |
| 5,957,400 | A | | 9/1999 | Brannen | |
| 5,957,401 | A | | 9/1999 | O'Donnell | |
| 5,975,459 | A | | 11/1999 | Roman | |
| 5,975,717 | A | | 11/1999 | Rahman | |
| 5,988,552 | A | | 11/1999 | Tisbo et al. | |
| D417,538 | S | | 12/1999 | Tisbo et al. | |
| D418,739 | S | | 1/2000 | Whitehead et al. | |
| 6,099,688 | A | | 1/2000 | Pedersen et al. | |
| 6,056,226 | A | * | 5/2000 | Green | 242/395 |

* cited by examiner

*Primary Examiner*—John M. Jillions
(74) *Attorney, Agent, or Firm*—Ryndak & Suri

(57) ABSTRACT

An apparatus and method is provided for storing and handling holiday light strings such as icicle lights. The device in accordance with the invention includes a vertically disposed rotatable spindle. The icicle light string can be conveniently wound on the spindle by rotating the spindle in the direction of winding. The device allows for ease of storage and handling of such light strings without any substantial tangling of the strings. When it is desired to mount the lights after a period of storage, the light strings can be readily unwound from the rotatable spindle and directly mounted at desired locations.

26 Claims, 4 Drawing Sheets

DEVICE AND METHOD FOR STORING HOLIDAY LIGHT STRINGS

FIELD OF THE INVENTION

The present invention relates to an apparatus for storing a string of lights, and in particular, an apparatus and method for storing and handling icicle lights prior to and after storage.

BACKGROUND OF THE INVENTION

Various types of decorative light strings are used for decorative purposes, particularly during holidays. The recent emergence of icicle light strings has increased the popularity associated with the tradition of stringing decorative lighting. Icicle lights have the distinctive feature of a plurality of transversely extending spaced parallel light strings that descend from a common wire cord. The added illumination from the descending portion of icicle lights yields vivid displays on outdoor shrubbery, houses, lawn fixtures and the like. The aesthetic ambiance provided by icicle lights is enjoyed not only during Christmas but during Halloween, the Fourth of July and summer—such as for patio lighting, for example.

While icicle lights are pleasing to view, storage and handling of such lights can be a frustrating and aggravating experience for those performing such tasks. Improper storage causes the icicle light string to become hopelessly tangled and knotted. Icicle light strings are particularly prone to knotting and tangling because of the descending portion's additional lengths of light strands. These descending light strands readily tangle among themselves as well as become tangled with the common wire portion.

If attempting to untangle a webbed mass of improperly stored icicle lights was not daunting enough, the mere act of untangling alone causes undo stress on both the light sockets and light bulbs causing damage to the socket connection and bulb breakage. Furthermore, during reinstallation of the icicle lights, knotting forces one continually to separate the descending strands from the common wire portion that is to be fastened on the desired mounting. This causes a substantial waste of time, delays the installation process and adds to the further frustration of the installer—particularly if the installer is in an elevated position or working upon a ladder.

Known handling techniques for storing holiday lights are inadequate for a variety of reasons. Coiling and looping an icicle light string like a rope does nothing to prevent the descending strands from becoming tangled. Moreover, apparatuses employing a horizontal reel about which the common wire portion is wound also do not prevent the descending strands from becoming tangled. Finally, attempting to return the icicle lights to their original package in an orderly manner is also impractical. Arranging the icicle lights to their original packaged configuration is tedious, time consuming and frustrating. Storing the icicle lights in the original packaging does not prevent tangling that occurs from the time the icicle lights are removed from their mounting until the time the lights are subsequently placed in their packaging.

SUMMARY OF THE INVENTION

In accordance with the present invention, an icicle light string storage and winding device is provided that comprises a generally vertically disposed rotatable spindle that may also include a crank arm on top of the spindle. The spindle is mounted for rotation on a spindle support. The icicle light string is wound around the spindle thereby enabling the descending strands of the icicle lights to hang in a downward manner. This prevents the descending light strands from becoming tangled both with themselves as well as with the common wire portion. Enabling the descending strands to hang downward also protects the light bulbs from breakage.

In accordance with one embodiment of the invention, the cross-sectional shape of the spindle can be selected from a group consisting of square, rectangular, flat, cylindrical, circular, oblong, elliptical, conical, tiered or tiered-conical in shape.

In accordance with another embodiment of the invention, a plurality of protrusions is dispersed on the exterior surface of the spindle. These protrusions are radially disposed on the exterior surface of the spindle to prevent the wound icicle light string from sagging downward.

Still another embodiment of the invention provides a crank arm that is retractable or completely detachable. Retraction of the crank arm occurs either telescopically or by folding the extensions of the crank arm back upon itself. The crank arm, in its detachable embodiment, is removable and readily snaps back into place by a fastening means. A handle is provided to make winding the crank arm less cumbersome on the user.

In accordance with a further embodiment of the invention, the spindle support comprises a plurality of legs that extend outward in a radial manner perpendicular to the spindle. These legs are preferably retractable such that during storage, space occupied by the storage and winding device is reduced.

In accordance with another embodiment of the invention, an assembly is provided for suspending the spindle vertically from a stationary object, such as a ladder, thereby allowing the spindle to rotate so that the icicle light string can unwind from the spindle.

A further embodiment of the invention provides an annular shaped skirt. The skirt is shaped such that it covers the top of the legs while providing a center opening exposing the rotation assembly thereby allowing free rotation of the spindle. The skirt separates the descending strands from the legs. In a preferred embodiment, the skirt is made from a resilient and flexible material that can be readily rolled up or folded and stored in the interior of the spindle.

In accordance with another aspect of the present invention, an icicle light string storage and winding device is provided that comprises a vertically disposed spindle with a crank arm on top of the spindle. The spindle is mounted for rotation on a spindle support. The exterior surface of the spindle is structured to prevent downward sagging when a light string is wound around the spindle.

In accordance with one embodiment of this invention, the cross-sectional shape of the spindle is tiered-conical.

In accordance with another embodiment of the invention, the exterior surface of the spindle has a plurality of radially disposed protrusions.

Another aspect of this invention provides a method for storing and handling at least one icicle light string comprising the steps of providing a vertically disposed spindle with a crank arm, a spindle support and a bearing for permitting rotation of the spindle relative to the spindle support; securing a first end of a first light string to the spindle; winding the common wire of the icicle light string around the spindle so that the descending light strands hang generally vertically downward. Thereafter, the lights so wound can be stored and conveniently unwound from the spindle and mounted directly to a desired location.

DETAILED DESCRIPTION OF THE PREFERRED EMBODIMENTS

Figure 1:
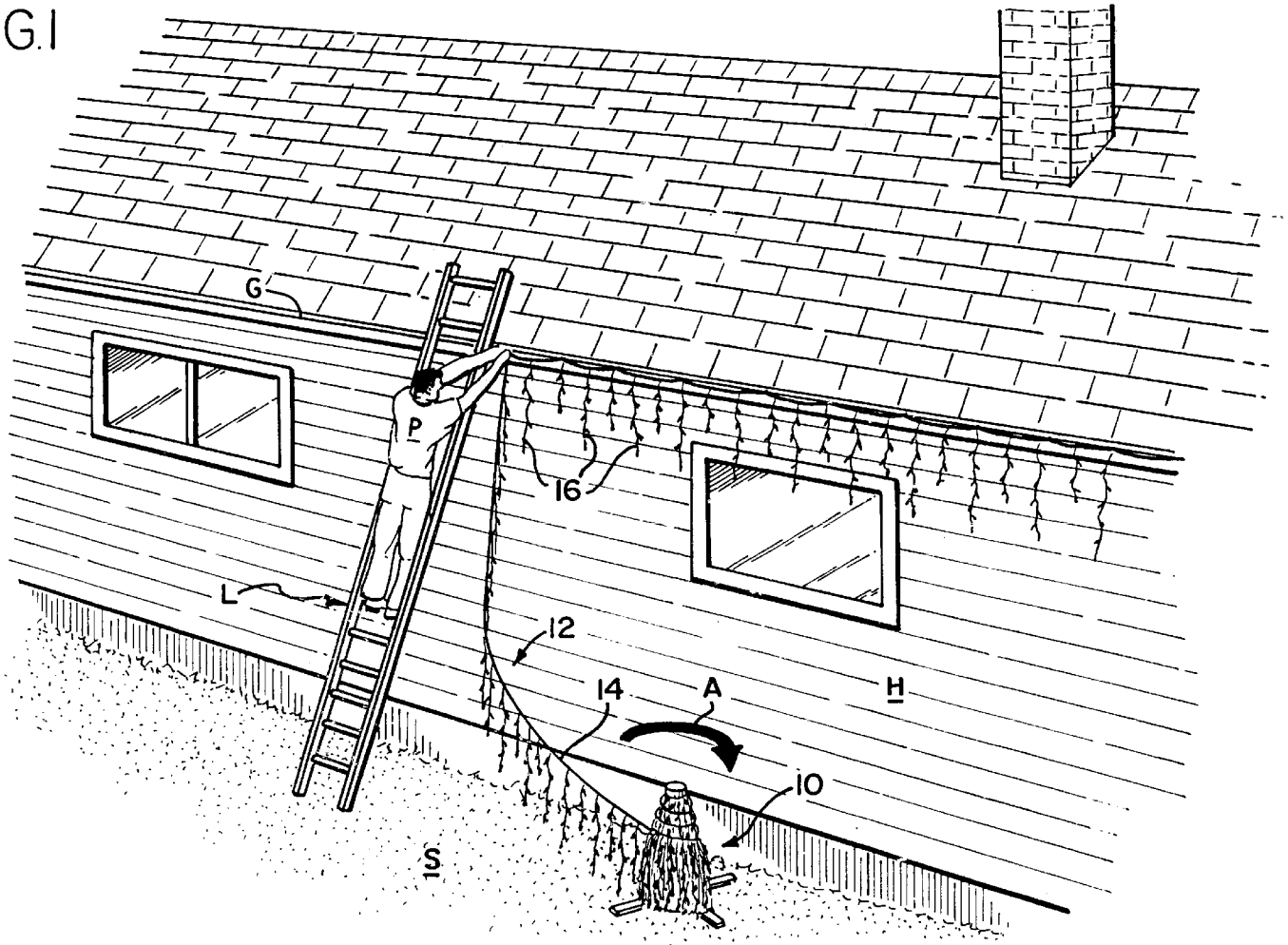
FIG. 1 is a perspective view illustrating a device in accordance with the invention in use during mounting of lights.

Referring to the Figures generally, where like reference numerals denote like structure and elements, and in particular to FIGS. 1–6, a light string storage and winding device 10 is for icicle light strings 12 having a common wire 14 and a plurality of transversely spaced parallel light strings 16 depending from the common wire.

Figure 2:
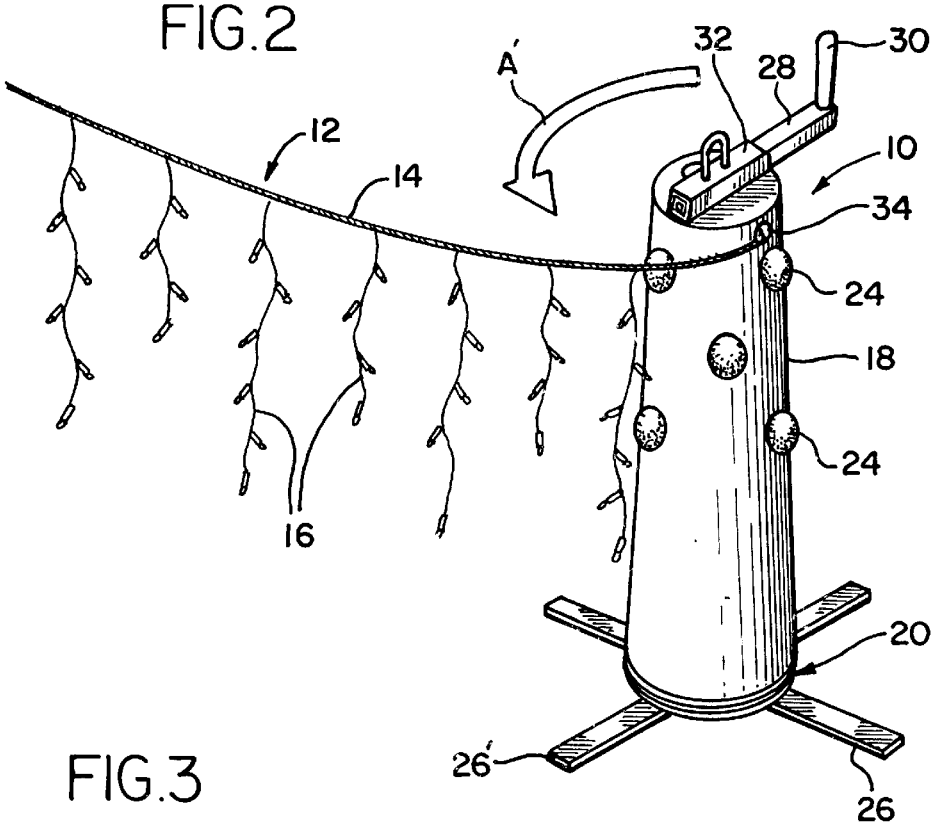
FIG. 2 illustrates in perspective view the light string storage and winding device in accordance with the invention.
Figure 8:
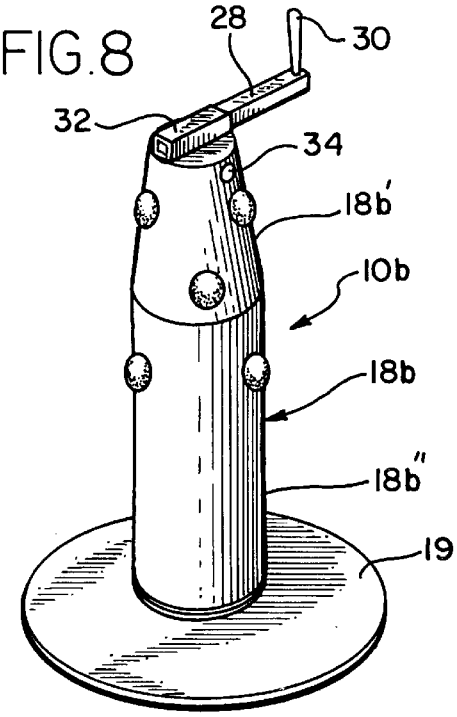
FIG. 8 illustrates in perspective view an alternate embodiment in accordance with the invention.
Figure 9:
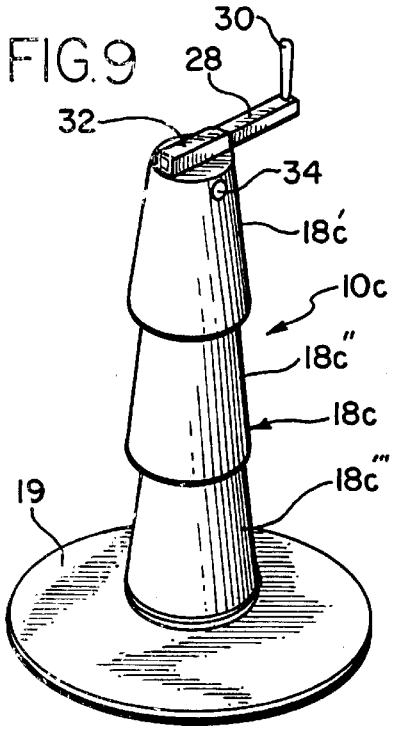
FIG. 9 illustrates in perspective view another embodiment of the device in accordance with the invention.

FIG. 2 depicts light string storage and winding device 10 comprising a vertical spindle 18 to hold icicle light string 12 when common wire 14 is wound thereabout. The cross-sectional shape of spindle 18 can be a multitude of shapes including square, rectangular, flat, circular, cylindrical, oblong, elliptical, conical, tiered or tiered conical such as, for example, as shown in FIGS. 8 and 9 with respect to light string storage and winding devices 10*b* and 10*c*. Storage and winding devices 10*b* and 10*c* have a circular solid rigid base 19 constructed of a suitable material which may be plastic, metal or wood, for example. Spindle 18*b* of device 10*b* has a top portion 18*b*' that is conical and a bottom portion 18*b*" that is cylindrical. Top conical portion 18*b*' also helps prevent sagging of a light string or strings wound thereon. Device 10*b* stores or permits storage of numerous light strings, such as about 20–25 icicle light strings, each of which strings is about 9 feet in length.

Storage and winding device 10*c* includes a spindle 18*c* that is composed of three conical portions 18*c*', 18*c*" and 18*c*'". Spindle 18*c* can be hollow and fabricated from a desired material, such as metal, wood, plastic, rubber or cardboard, for example.

Figure 3:
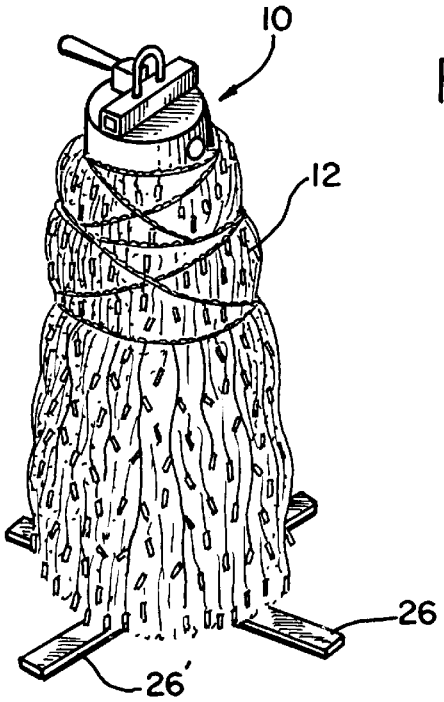
FIG. 3 illustrates the device of FIG. 2 having a quantity of icicle lights stored thereon.
Figure 6:
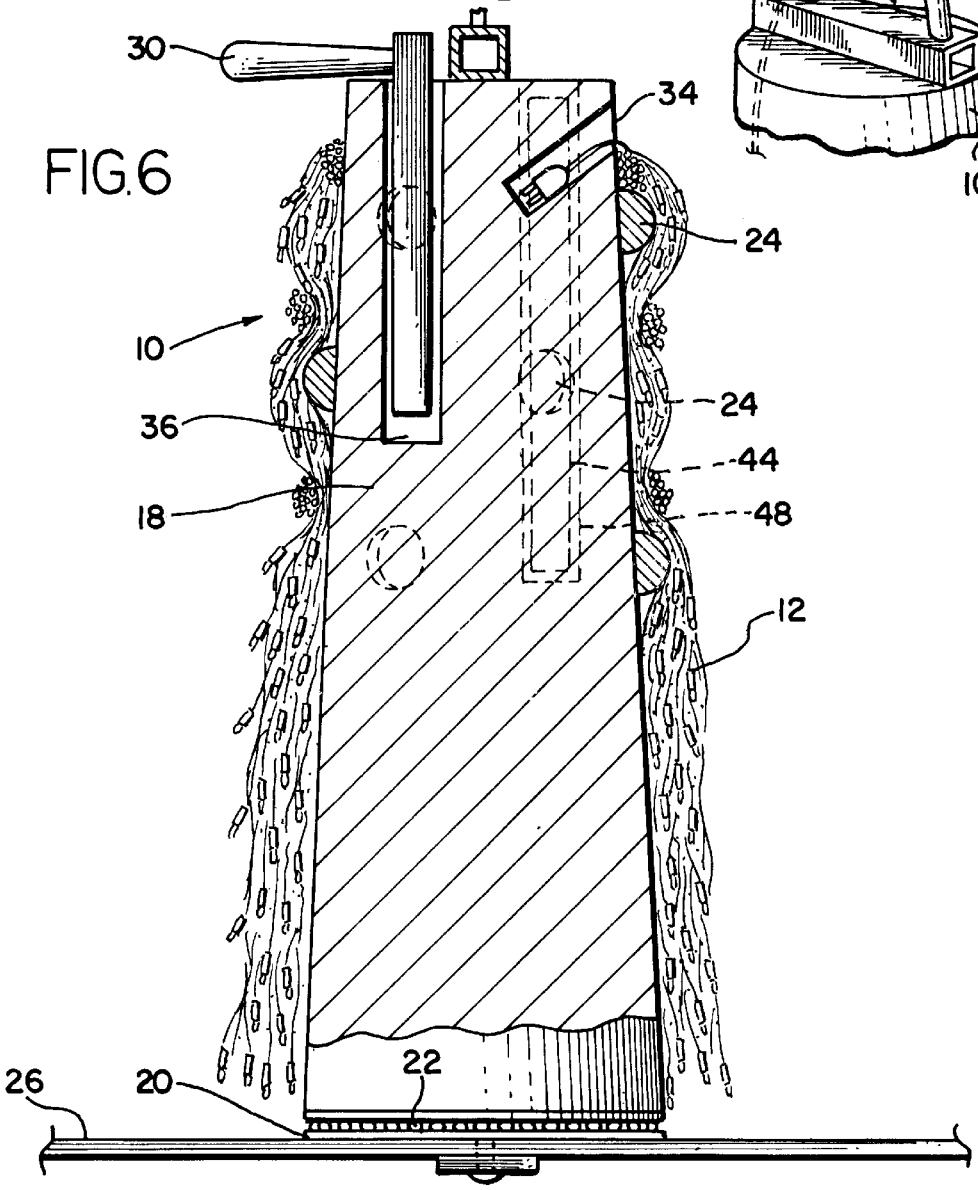
FIG. 6 is a sectional view along line 6—6 of FIG. 5.

In a preferred embodiment, the exterior surface of spindle 18 has a plurality of protrusions 24. These protrusions 24 can be of any desired shape that extends radially outward from the exterior surface of spindle 18. Preferably, protrusions 24 are convex dimples and may be semi-spherical. The protrusions 24 keep the common wire 14 in place or prevent excessive drooping or slumping of common wire 14 when the icicle light string 12 is wound about the spindle 18. Protrusions 24 also prevent wound icicle light strings 12 from sagging during storage while wound about spindle 18 as depicted in FIGS. 3 and 6. Protrusions 24 are fabricated from a suitable material such as wood, plastic, metal, rubber or styrofoam and can be integrally formed on the surface of spindle 18.

Figure 4:
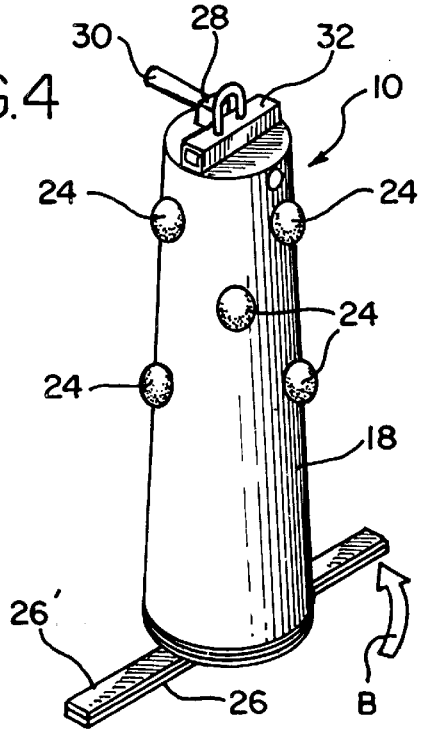
FIG. 4 illustrates operation of the foldable base of the device of FIG. 2.
Figure 5:
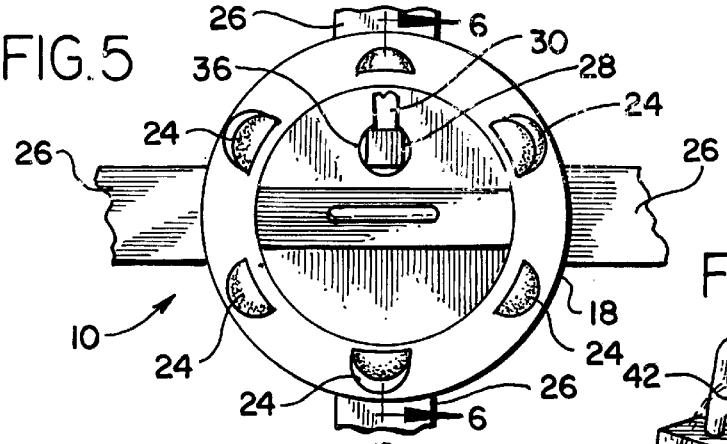
FIG. 5 is a top plan view of the device of FIG. 2.

A spindle support 20 maintains spindle 18 in a substantially vertical position when placed on a generally horizontal surface. In one embodiment, spindle support 20 is comprised of legs 26 and 26'. Legs 26 can be folded as shown in FIG. 4 to minimize storage space while device 10 is not in use by pivoting legs 26 in the direction indicated by arrow B so that legs 26 overlap legs 26'.

FIG. 6 depicts a bearing 22 that permits rotation of spindle 18 relative to spindle support 20. Bearing 22 can be of any suitable construction as long as the desired function is achieved.

The light string storage and winding device 10 can be utilized in a number of ways. For example, device 10 can be used to store lights at the end of the holiday season, or when one desires to take down lights and put them in storage. Alternatively, device 10 having lights stored thereon can be conveniently utilized to mount the lights in a desired location, such as on the exterior or interior of a house, for example. To wind and store icicle lights 12 around device 10, a crank arm 28 is attached to arm mount 32. Crank arm 28 preferably has a handle 30. The upper end of spindle 18 has a bore 34 capable of receiving an end of a light string 12. Bore 34 is angled inwardly downward as shown in FIG. 6 so that when an end of icicle light string 12 is inserted therein, the end remains securely in place. Handle 30 is turned in either a clockwise or counterclockwise direction (shown in FIG. 2 in the direction of arrow A' for winding lights 12 thereon) as desired until the entire common wire 14 of icicle light string 12 is wrapped around spindle 18 in the direction of rotation of spindle 18. Common wire 14 is wound around spindle 18 so that the parallel light strings 16 are disposed generally vertically downwardly. The icicle light string 12 is preferably wound around the upper portion of spindle 18 to avoid the parallel light strings 16 from dragging on the ground or getting caught in legs 26. After use, crank arm 28 may be removed from arm mount 32 and stored in arm bin 36 located in the inner upper portion of spindle 18 as shown in FIG. 6.

Figure 7:
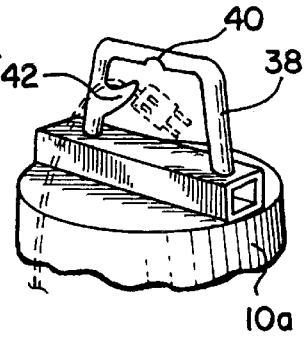
FIG. 7 is a partial perspective view of an alternate embodiment of the device of FIG. 2.

In FIG. 7, a handle 38 is attached on top of arm mount 32 of light string storage and winding device 10*a*, which is similar to device 10 previously described except for the illustrated differences. On the underside of the upper extension of handle 38, is notch 40. Notch 40 is adapted to engage a hook (not shown). This enables hanging of winding and storage device 10*a* during storage such as from a closet rod or other suitable location as desired. Extending inwardly and upwardly from one vertical post of handle 38 and directly under the upper extension of handle 38, is a finger 42. Finger 42 is adapted to secure the other end of icicle light string 12 firmly in place once the icicle light string 12 is fully wound around spindle 18.

Figure 10:
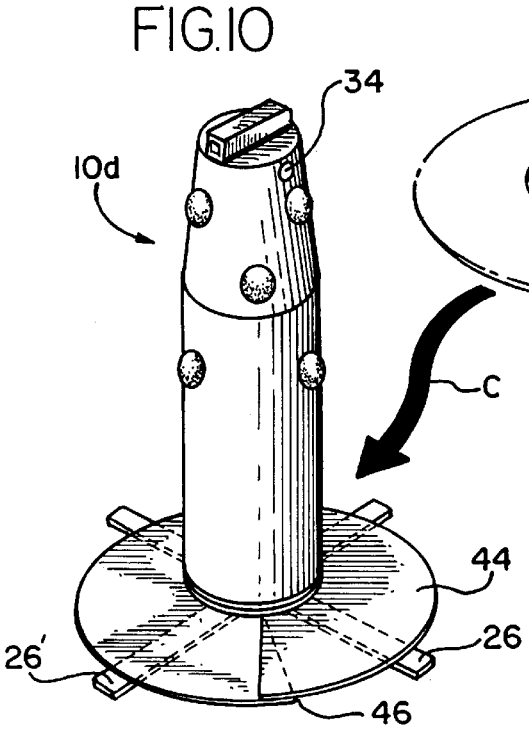
FIG. 10 illustrates still another embodiment of the device in accordance with the present invention.
Figure 10:
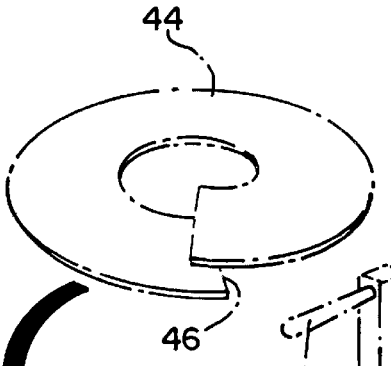

Referring to FIG. 10, in another embodiment of the invention, an annular skirt 44, preferably constructed of flexible material, is placed on top of legs 26 forming a partition that prevents the generally vertically downward hanging parallel light strings 16 from getting tangled with legs 26. Slit 46 allows for easy placement and removal of skirt 44 over legs 26 illustrated by arrow C while simultaneously allowing spindle 18 to freely rotate. Annular skirt 44 can be made of a resilient lightweight, flexible material selected from a group consisting of plastic, rubber or fabric, for example. After use, skirt 44 may be removed from the top of legs 26 and rolled up and stored in skirt envelope 48 which is located in the inner upper portion of spindle 18 opposite arm bin 36 as depicted in FIG. 6.

Light string storage and winding device 10 is also conveniently utilized to unwind icicle light string 12, such as when it is desired to mount the lights in a desired location, such as the exterior of a house as shown in FIG. 1. FIG. 1 illustrates icicle light string 12 being unwound in a clockwise direction indicated by arrow A from light string storage and winding device 10 by person P on ladder L, who is at an elevated position relative to device 10, located on ground surface S. With crank arm 28 stored in arm bin 36, common wire 14 unwinds freely from spindle 18, which rotates clockwise in the direction of unwinding of common wire 14, and parallel light strings 16 hang untangled while person P mounts icicle light string 12 to gutter G, house H or other structure as desired. Thus, in accordance with the invention, a convenient method is provided for storing and handling (both when taking down and putting up icicle light strings). The methods of the invention allow for easy and efficient handling of icicle light strings while avoiding bothersome tangling of such lights which may otherwise occur.

Figure 11:
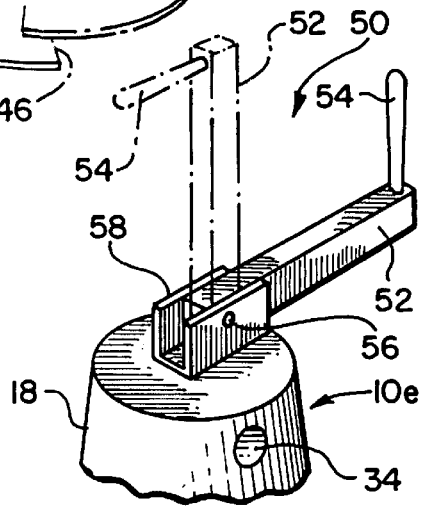
FIG. 11 illustrates a partial perspective view of still another embodiment of the device in accordance with the invention.

Referring to FIG. 11, there is illustrated an alternate embodiment light storage and winding device 10*e* shown in fragmentary perspective view. Storage and winding device 10*e* is similar to storage and winding device 10 except for the handle configuration. Storage and winding device 10*e* is provided with a handle configuration 50 that includes a crank arm 52 and a handle 54. Crank arm 52 is mounted for pivotal movement about a pivot axis defined by a pin 56 extending through an end of crank arm 52 and mounted to top of spindle 18 by a mounting channel 58 which is rigidly secured to the top of spindle 18. Crank arm 52 can be pivoted from an operating position as illustrated in FIG. 11 to a storage or light removal position indicated by dotted lines in FIG. 11.

While the invention has been described with respect to certain preferred embodiments, as will be appreciated by those skilled in the art, it is to be understood that the invention is capable of numerous changes, modifications and rearrangements and such changes, modifications and rearrangements are intended to be covered by the following claims.

What is claimed is:

1. A light string storage and winding device for an icicle light string, the light string having a transversely extending common wire and a plurality of transversely spaced parallel light strings depending from said common wire, comprising:

a substantially vertically disposed spindle having a top and bottom;

a spindle support located beneath the spindle for maintaining said spindle in the substantially vertical position when placed upon a generally horizontal surface;

means for permitting rotation of the spindle relative to the spindle support; and at least one icicle light string wound around an upper portion of the spindle with the plurality of transversely spaced parallel light strings disposed generally vertically downwardly.

2. The device of claim 1 wherein the cross-sectional shape of said spindle is selected from the group consisting of square, rectangular, flat, cylindrical, circular, oblong, elliptical, conical, tiered and tiered-conical shapes.

3. The device of claim 1 wherein said spindle is aligned for rotation along a vertical longitudinal center line of the spindle and has an exterior surface spaced a distance from said centerline, said exterior surface being generally cylindrical and having a plurality of protrusions, said protrusions being disposed at least on an upper portion of said spindle.

4. The device of claim 3 wherein said protrusions are convex dimples.

5. The device of claim 1 including means for suspending said spindle vertically from a stationary object, to allow said spindle to rotate thereabout so that the icicle light string can freely unwind from said spindle.

6. The device of claim 1 further comprising a crank arm attached to the top of said spindle for facilitating rotation of the spindle by hand.

7. The device of claim 6 wherein a handle is mounted to said crank arm.

8. The device of claim 6 wherein said crank arm is retractable.

9. The device of claim 1 wherein said spindle support comprises a plurality of legs extending radially outward from said vertical centerline.

10. The device of claim 9 wherein said legs are foldable.

11. The device of claim 9 having an annular skirt, said skirt adapted to be placed on top of said legs to partition said plurality of transversely spaced parallel light strings disposed generally vertically downward from said legs.

12. The device of claim 11 wherein said skirt is made of resilient, flexible material.

13. The device of claim 11 further comprising an opening in said spindle for storing said skirt therein when not in use.

14. The device of claim 1 wherein said spindle has at least one opening in an upper portion thereof to receive one end of a light string.

15. A method for storing at least one icicle light string, the light string having a transversely extending common wire and a plurality of transversely spaced parallel light strings depending from said common wire comprising:

providing a substantially vertically disposed spindle having a top and bottom; a spindle support located beneath the spindle for maintaining said spindle in a substantially vertical position when placed upon a generally horizontal surface; and a bearing for permitting rotation of the spindle relative to the spindle support;

securing a first end of a first icicle light string to said spindle;

winding said common wire around an upper portion of said spindle;

wherein the plurality of transversely spaced parallel light strings is disposed generally vertically downwardly.

16. The method of claim 15 further comprising attaching a second end of the first icicle light string to a first end of a second icicle light string and winding the common wire of the second string around the spindle.

17. The method of claim 16 wherein said attaching is accomplished by inserting a male plug of one light string into a female plug of the other light string.

18. The method of claim 15 wherein said light string is helically wound around said spindle.

19. The method of claim 15 wherein said winding step is performed while rotating the spindle in the direction of winding.

20. The method of claim 15, further comprising unwinding the common wire from the spindle.

21. The method of claim 20 wherein the unwinding step is performed while rotating the spindle in the direction of unwinding.

22. A light string storage and winding device comprising a substantially vertically disposed spindle having a bottom portion and an inwardly tapered upper portion; a spindle support located beneath the spindle for maintaining said spindle in a substantially vertical position when placed upon a generally horizontal surface; a bearing for permitting rotation of the spindle relative to the spindle support; and a plurality of spaced apart convex dimples disposed on at least said upper portion to prevent sagging of one or more light strings wound around said spindle.

23. The device of claim 22 wherein said spindle support comprises a plurality of legs extending radially outward from a central portion of said spindle support and the device further comprises an annular skirt placed on top of said legs to shield said light strings from said legs.

24. The device of claim 23 wherein said skirt is made of resilient, flexible material.

25. The device of claim 23 wherein said skirt is removable and can be rolled up when not in use.

26. The device of claim 23 wherein said spindle includes an opening permitting storage of the skirt therein.

* * * * *